US007007811B2

(12) United States Patent
Moore

(10) Patent No.: US 7,007,811 B2
(45) Date of Patent: Mar. 7, 2006

(54) COMPRESSED AIR AND ELECTRIC CONNECTIONS WORKSTATION

(75) Inventor: Jim Moore, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 191 days.

(21) Appl. No.: 10/229,746

(22) Filed: Aug. 28, 2002

(65) Prior Publication Data

US 2004/0040918 A1 Mar. 4, 2004

(51) Int. Cl.
*A47F 7/00* (2006.01)

(52) U.S. Cl. ..... 211/70.6; 211/13.1; 211/71.01

(58) Field of Classification Search ..... 211/70.6, 211/1.51, 86.01, 183, 71.01, 13.1; 312/107, 312/117, 128, 902; 206/335, 373; 224/451, 224/454; 248/127, 146, 128, 158
See application file for complete search history.

(56) References Cited

U.S. PATENT DOCUMENTS 3,874,531 A * 4/1975 Mayo ..... 414/680
4,514,019 A * 4/1985 Moore ..... 312/209
4,542,909 A * 9/1985 Littwin et al. ..... 280/79.11
4,976,450 A * 12/1990 Ellefson ..... 280/79.11
5,083,669 A * 1/1992 Wisehart ..... 211/70.6
5,152,406 A * 10/1992 Kling et al. ..... 211/70.6
5,740,910 A * 4/1998 Ueng ..... 206/373
5,772,047 A * 6/1998 Bostjancic ..... 211/13.1
5,862,920 A * 1/1999 Leisner ..... 211/13.1
6,170,839 B1 * 1/2001 Kizewski ..... 280/47.26
6,199,705 B1 * 3/2001 Portner ..... 211/26
6,481,678 B1 * 11/2002 Chong ..... 248/220.42
6,578,938 B1 * 6/2003 Norman et al. ..... 312/290

* cited by examiner

*Primary Examiner*—Jennifer E. Novosad
(74) *Attorney, Agent, or Firm*—Standley Law Group LLP

(57) ABSTRACT

A multi-function workstation particularly adapted for use by a mechanic while working at the side or underneath a vehicle that is raised on a hydraulic lift. The workstation may be mounted to a wall or shaft near the periphery of the vehicle being worked on or, if possible, to the shaft of the hydraulic lift itself. Electric power and compressed air are supplied to the workstation where connections for electrical cords and compressed air are provided together with convenient supports for one or more compressed air driver devices. Located between a top and bottom section of the workstation that provide for electrical and compressed air access, respectively, are two middle sections comprising open-faced, removable boxes. The boxes contain supports of several types for holding tools or supplies used by a mechanic.

16 Claims, 5 Drawing Sheets

COMPRESSED AIR AND ELECTRIC CONNECTIONS WORKSTATION

BACKGROUND OF THE INVENTION

The present invention relates to tool support assemblies for presenting to a user tools typical for working on the underside of an automotive vehicle after the vehicle is raised on a hydraulic or other type of lift.

Undercarriage work facilitated by a hydraulic lift is a daily occurrence in automotive repair establishments. Some of the most repeated tasks involve removal and replacement of standard size nuts and bolts. Unfortunately, the mechanic is presented with tools located a safe distance from the periphery of the raised vehicle, such distance being maintained so that the tools and their electrical or compressed air connections do not interfere with the raising or lowering of the vehicle. The mechanic moves many times back and forth from the periphery or undercarriage of the vehicle to obtain tools and supplies to work on the raised vehicle in those locations. There is a need for a device that will eliminate much of that mechanic motion, thereby reducing repair time on a vehicle.

SUMMARY OF THE INVENTION

The present invention is a multi-function workstation for a mechanic to use while working at the side of or underneath a vehicle raised on a hydraulic lift. The workstation is mounted on a wall or shaft near the periphery of the vehicle to be worked on or, if possible, to the shaft of the hydraulic lift itself. Electric power and compressed air are supplied to the workstation, whereat connections for electrical cords and compressed air are provided together with convenient supports for one or more compressed driver devices. Located between a top and bottom section of the workstation for electrical and compressed air access respectively are two middle sections comprising open faced boxes that are removable. The boxes may contain supports of several types for tools or supplies used by a mechanic.

The invention workstation eliminates the need for substantial horizontal storage surface for some of the most frequently used tools and supplies in undercarriage work.

DETAILED DESCRIPTION OF THE INVENTION

The invention is now discussed with reference to the figures.

It is well known that hydraulic lifts raise vehicles for inspection and work on undercarriage parts. For example, oil changes and tire changes/rotations are the simpler operations accomplished with such hydraulic lifts. However, among the most difficult physical and technical operations on a vehicle are performed while the vehicle is raised on a hydraulic lift. A significant problem for the mechanic arises because of the necessary operation of the hydraulic lift. The mechanic typically uses several types of tools, i.e., hand powered, electrically powered and air powered. In the past, the mechanic would need to walk from a collection of tools at a tool bench or tool chest, walk to a connection for electrical power or compressed air to respectively connect an electrical cord or flexible air hose, and then finally walk to the side or undercarriage of the vehicle to work there. If a change in tools was needed, the operation was repeated.

Figure 1:
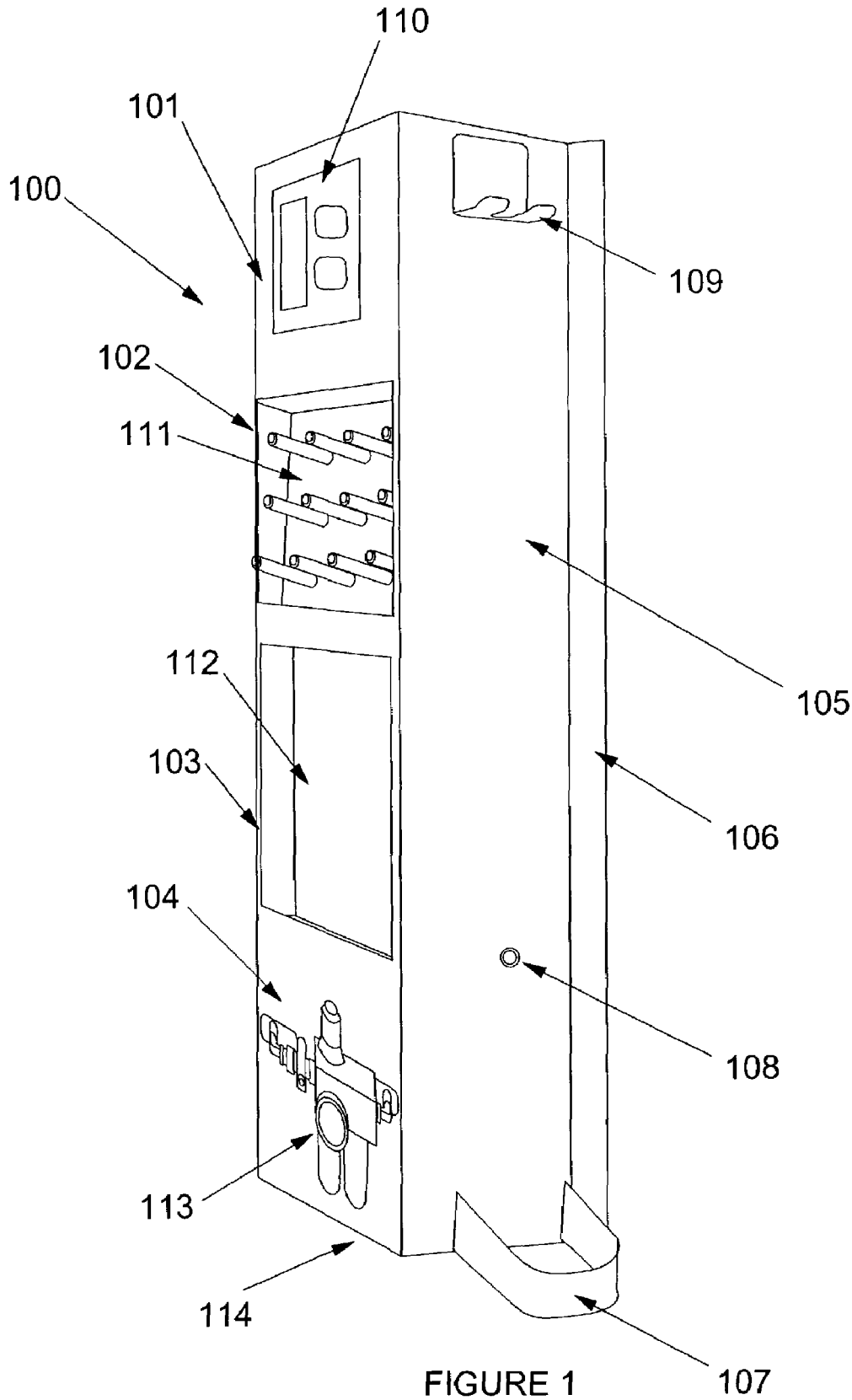
FIG. 1 is a perspective side view of the workstation.
Figure 6:
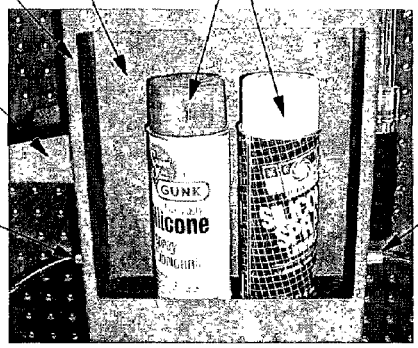
FIG. 6 is a front view of the lower middle section of the workstation.

FIG. 1 shows a perspective side view of the invention workstation. The workstation 100 comprises four stacked sections 101–104. In a preferred embodiment, the dimensions of the outer housing are about 33 inches long, 9 inches wide and 6 inches deep. The four sections 101–104 are stacked from the top down. Top section 101 has means for electrical connection and brackets for a torque wrench and pry bar. Upper middle section 102 has means for supporting and storing sockets so that a mechanic can easily use and replace them. Lower middle section 103 has means for supporting and storing typical supplies for undercarriage work, i.e., spray cans 116, 139 (see FIGS. 2 and 6) and tubes of lubricants and other materials. Lower middle section 103 also has means at a side for supporting and storing nuts, bolt and other small parts removed by a mechanic in undercarriage work. Bottom section 104 has means for connection of the workstation to a source of compressed air, a valved regulator for control of the delivered air pressure to the workstation, and hose connections and hoses for connection of compressed air tools to the workstation. Bottom section 104 also has means for convenient support of one or two compressed air tools attached to the compressed air hoses.

Figure 3:
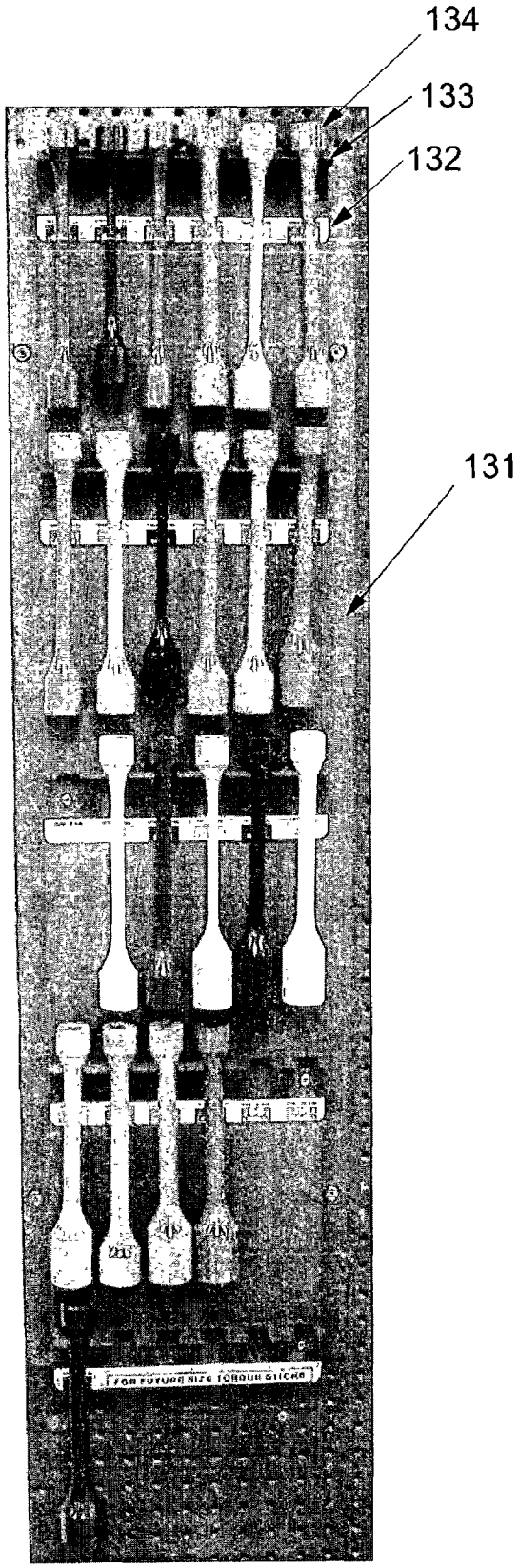
FIG. 3 is a front view of a complementary torque stick support device.
Figure 4:
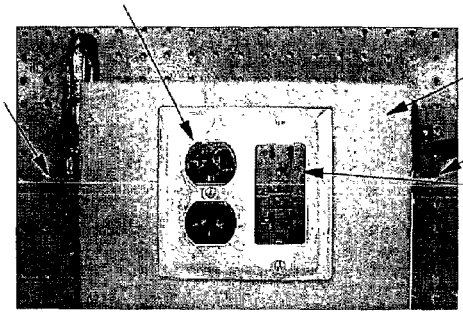
FIG. 4 is a front view of the top section of the workstation.
Figure 5:
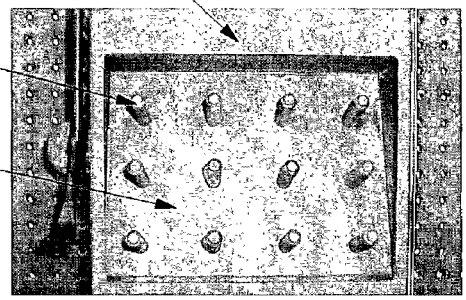
FIG. 5 is a front view of the upper middle section of the workstation.

FIG. 3 shows a supplemental device for the invention workstation. Rack 131 comprises 5 rows of slotted support ledges 133 for torque sticks 134, as indicated by color and/or number coding on labels 132. Rack 131 is generally intended to be mounted by the side of the invention workstation so that the torque sticks 134 can be used with the wrenches and electric and air driven tools associated with the workstation.

Figure 2:
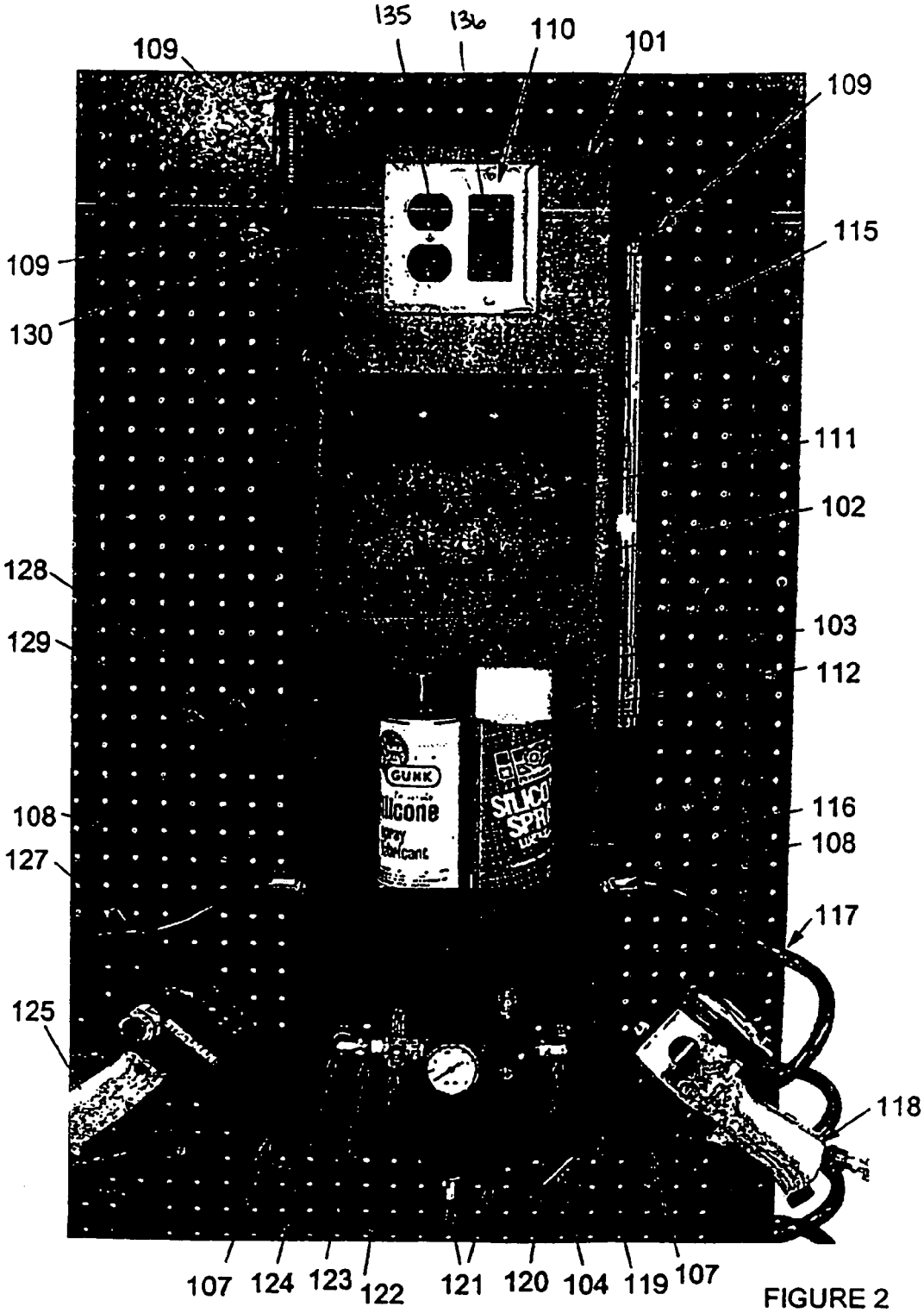
FIG. 2 is a front view of the workstation.

As shown in FIGS. 1 and 2, the workstation generally has an outer housing defining a rectangular box open at a back side and substantially liquid sealed about to the top surface of top section 101 and sides 105. Connection flanges 106 extend from the side peripheral edges of the open back side of the outer housing, i.e., from sides 105, although such connection flanges are extensible from the top and bottom sides for vertical wall attachment while eliminating side flanges 106 or retaining them. Flanges 106 are connected by bolts, welds or other connection methods to a substantially vertical support wall. The invention sections are more particularly described below.

Top section 101 is shown in FIGS. 1, 2, 4, 8, 9 and 10. Top section 101 comprises electrical connection means 110 available to a user from a front part and wrench brackets 109 extending from and available to a user from side parts.

Electrical connection means 110 comprises the cover plate and the four receptacles 135, 136 shown, as well as a set of connections to those receptacles behind the cover plate in a connection box, wherefrom electrical power connection wires extend the length of the workstation 100 to emerge at the bottom housing 114 and thereafter to a source of electrical power. The connection of electrical power and compressed air (in section 104) to the workstation 100 are made through bottom housing 114 of bottom section 104, where both sets of connecting wires and hoses respectively are flexible such that the workstation 101 may rise and descend with a hydraulic lift without interfering with the electrical and compressed air connections and so that such flexible connections do not interfere with the movements of the mechanic about the under carriage of a vehicle on the lift. Multiple electrical receptacle sockets 135, 136 are connected with a source of electrical power so a user may, in this specific example, connect up to four electrical power tools to the workstation 100 and thereby have them immediately available. The close association of the workstation 100 with the undercarriage of a vehicle should permit the mechanic to use desired electrical power tools without an additional extension cord. Receptacles 136 may be provided with a ground fault circuit interrupter so that a mechanic working in water contaminated areas will have protection from shock from electrical tools used there, thereby also providing easy reach to reset the GFCI breaker if a water initiated short occurs.

Top section 101 has wrench brackets 109 comprising a plate welded to the side of the workstation housing extending to two lateral prongs 142 bent up at their ends 143 to retain an enlarged head end of wrench 115. The workstation 100 is mounted on a vertical surface, preferably the side of the shaft of the hydraulic lift, at a height making the handle of wrench 115 easily within reach of the mechanic to work on the undercarriage of a vehicle on the lift. It will be seen in FIG. 8 that wrench 115 can be easily lifted from and replaced on bracket 109 during work operations by a mechanic.

Top section 101 comprises the electrical connections for electrical tools because some undercarriage work involves electrically conductive fluids such as water, so that only the topmost section need be sealed against dropping water or liquid intrusion.

Middle sections 102 and 103 each comprise an opening in the overall support housing for the workstation wherewithin from an inside surface is supported a function box. Each function box comprises an opening and support within for a desired range of tools and/or expendable supplies used by the worker on the underside of a vehicle. Each box may also comprise additional compressed air or electrical outlet means as shown and described for sections 101 and 104. Each function box comprises attachment means in the form of flanges for its attachment at the inside surface periphery of the backside of the workstation housing openings located in sections 102 and 103. The invention workstation provides modularity in sections 102 and 103 so that it can be adapted to contain frequently used tools or supplies depending on the particular operation of the shop in which the workstation is located. For example, some shops specialize in brakes and alignments while others specialize in major overhauls. The specific examples of the function boxes shown in the figures are adapted for a general repair shop working on tires, brakes, shock absorbers and alignments.

Figure 10:
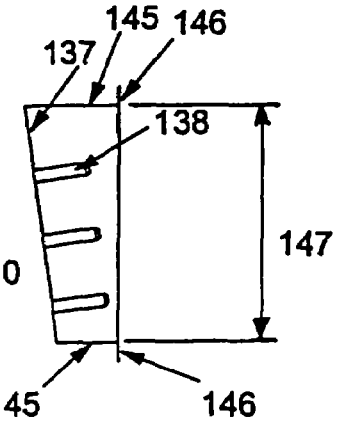
FIG. 10 is a sectional view taken along line V—V of FIG. 9.

FIGS. 1, 2, 5, 9 and 10 show section 102 features, where function box 111 comprises an angled back wall 137 having pegs 138 mounted thereon normal to wall 137 so that 12 of the most used sockets can be supported, removed and replace with ease by a mechanic. Box 111 also comprises top walls 145 and side walls 144, where flanges 146 extend from the edges of top walls 145. Flanges 146 secure box 111 to the workstation housing and are attached to the back side surface of the workstation housing in such a way to prevent access to the interior of the workstation housing behind box 111, thereby protecting wires and/or compressed air hoses that may be within that space. Window height 147 in FIG. 10 shows that the vertical distance of opening of section 102 of the workstation housing is about equal to the vertical distance of the opening of box 111.

Figure 12:
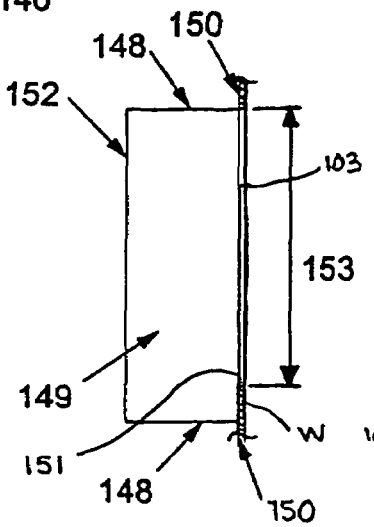
FIG. 12 is a sectional view taken along line L—L of FIG. 11.
Figure 11:
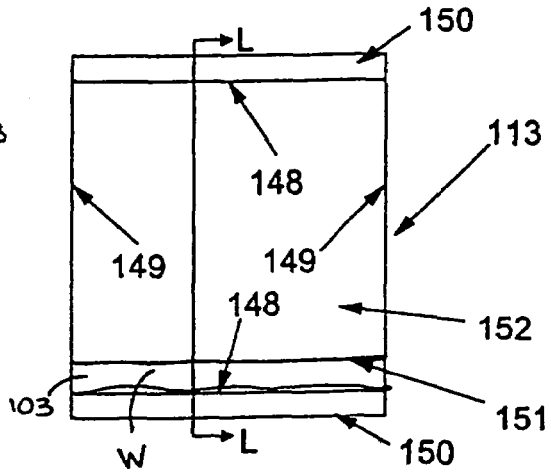
FIG. 11 is a front view of a function box for the lower middle section.

FIGS. 1, 2, 6, 11 and 12 show section 103 features, where function box 112 comprises a vertical back wall 152. Box 112 also comprises top and bottom walls 148 and side walls 149, where flanges 150 extend from the edges of top and bottom walls 148. Flanges 150 secure box 112 to the workstation housing and are attached to the back side surface of the workstation housing in such a way as to prevent access to the interior of the workstation housing behind box 112, thereby protecting wires and/or compressed air hoses that may be within that space. Window height 153 in FIG. 12 shows that the vertical distance of the opening in the workstation housing of section 103 is substantially less than the vertical distance of the opening of box 112. Box 112 is secured to the inside of the workstation housing so that the bottom wall 148 is located substantially below the lower edge 151 of the opening in the workstation housing of section 103. FIGS. 2 and 12 show that this securement creates a barrier wall W preventing spray cans 116, 139 from being inadvertently knocked out of placement in the box 112 secured in section 103. The specific example in the figures of section 103 is to provide a place for secure placement of spray cans 116, 139 or other supplies.

Section 103 comprises a side tray 128 secured to the left side 105 of the workstation housing. Tray 128 comprises a substantial ledge 129 to form an open tray in which can be stored several small to large size nuts, bolts and other such parts removed from the vehicle or placed there in preparation for installation on a vehicle. Section 103 also comprises extending from and through the sides 105 of the workstation the compressed air connections 108 that connect to hoses 117 and 127, which hoses connect compressed air drivers 118 and 125 to the compressed air supply available from the compressed air means of section 104.

Figure 7:
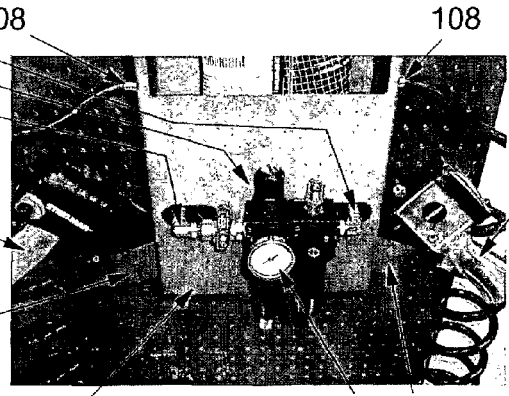
FIG. 7 is a front view of the bottom section of the workstation.
Figure 8:
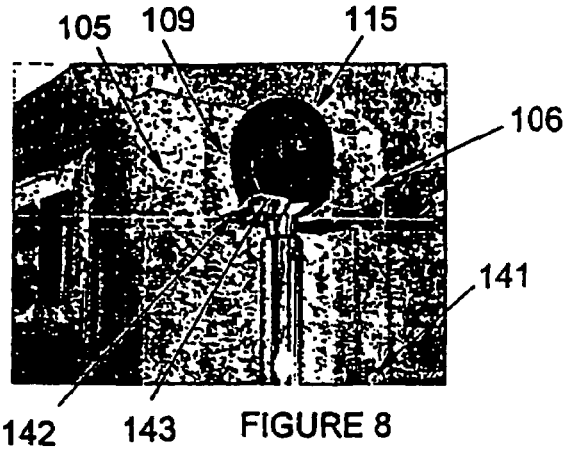
FIG. 8 is a side perspective view of the top section of the workstation.
Figure 9:
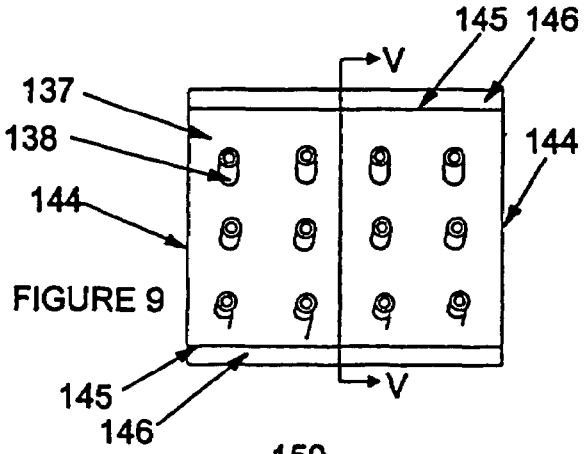
FIG. 9 is a front view of a function box for the upper middle section.

Section 104 is shown in FIGS. 1, 2, and 7. Section 104 comprises compressed air means and driver supports. Compressed air is delivered to the workstation via pipes or hoses through the bottom side 114 of the workstation housing, whereafter pipes or hoses deliver the compressed air through external fittings 124 and 123 to the valve 122. Valve 122 is a hand operated valve that permits the flow of compressed air to the regulator 121, wherein the compressed air pressure is regulated so that only a desired air pressure is delivered to downstream hoses and drivers. After passing through an opened valve 122 and regulator 121, compressed air passes through fitting 120 and is distributed via conduits to air connections 108.

Section 104 also comprises one or two U-shaped holster brackets 107 attached to sides 105 at connection 119. FIG. 2 shows that brackets 107 allow insertion of a front, driver end 104 to be inserted into the U-shaped opening of a bracket 107 with a hand grip section supported upward and lateral to bracket 107, making it easy to retrieve a driver 118 or 125 from bracket 107, install a torque stick or socket on such a driver, use the driver on a vehicle, and store the driver with the attachment back in bracket 107 without having to remove the attachment.

With step saving means in mind, the present invention also comprises a mounting plate as shown in FIG. 3 with means for attachment of open plastic or thin metal trays or bins adapted to hold balancing weights for use in tire balancing. The availability of the balancing weights near the tire mounting and balancing machines reduces steps needed to complete those operations.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A compressed air and electric connections workstation comprising:

(a) a workstation housing comprising a rectangular box open at a backside with the length oriented vertically, the box adapted for attachment to a vertical post or wall within a few feet of the periphery of a vehicle to be raised on a hydraulic or mechanical lift for servicing by a mechanic, the workstation housing further comprising four vertically arranged sections consisting of a top section, an upper middle section, a lower middle section, and a bottom section;

(b) the top section comprising one or more electrical receptacles electrically connected with a source of electrical power through a bottom side of the bottom section, such that the electrical receptacles are adapted for connection of cords for electrically powered hand tools;

(c) the bottom section comprising compressed air means for receiving compressed air from a conduit at the bottom side of the bottom section and subsequently delivering a flow of compressed air at a regulated pressure to one or more hose connections, each hose connection extending to a driver hose connectable with a compressed air driver tool;

(d) each of the upper middle section and lower middle section comprising an opening in a front side of the workstation housing, each opening leading into a separate function box that is affixed to an inside surface of the front side of the workstation housing and adapted to store tools or supplies for access by a mechanic through the respective front side opening.

2. The workstation of claim 1 wherein the function box of the upper middle section comprises means for storing sockets.

3. The workstation of claim 2 wherein the function box of the upper middle section comprises a sloped back wall with forward projecting pegs adapted to releasably retain the sockets.

4. The workstation of claim 1 wherein the function box of the lower middle section comprises means for storing spray cans.

5. The workstation of claim 4 wherein the function box of the lower middle section comprises a lower wall that intersects with the front side of the workstation housing at a point below a bottom of the opening located therein, the front side of the workstation housing thereby forming a barrier wall across a front bottom edge of the function box.

6. The workstation of claim 1 wherein the top section comprises slotted brackets mounted at the sides of the workstation housing adapted to support ratchet tools with a head larger than a handle shaft.

7. The workstation of claim 1 wherein the lower middle section comprises an open tray fixed to a side of the workstation housing and adapted to support and retain nuts and bolts.

8. The workstation of claim 1 wherein the bottom section comprises compressed air driver holster means fixed to a side of the workstation housing and adapted to support and freely releasably retain a compressed air driver such that when the air driver is inserted into the holster means, a user grip is upwardly presented to a user.

9. The workstation of claim 8 wherein the holster means comprises a U-shaped bracket attached at the ends of the U-shape to an exposed side of the workstation housing.

10. The workstation of claim 9 wherein the U-shaped bracket is angled down and away from the workstation housing.

11. The workstation of claim 1 wherein the compressed air means comprises a regulator and valve to turn compressed air flow to the workstation on or off.

12. The workstation of claim 1 wherein the workstation housing has a length of about 24 to 48 inches.

13. The workstation of claim 1 wherein each driver hose is connected to a compressed air driver tool with a pistol type grip.

14. The workstation of claim 13 wherein the bottom section comprises compressed air driver tool holster means fixed to a side of the workstation housing and adapted to present the pistol type grip to the user when the compressed air driver tool is inserted into the holster means.

15. The workstation of claim 14 wherein the holster means comprises a U-shaped bracket attached at the ends of the U-shape to an exposed side of the workstation housing.

16. The workstation of claim 15 wherein the U-shaped bracket is angled down and away from the workstation housing.

* * * * *